US006933016B1

(12) United States Patent
Sykes, Jr.

(10) Patent No.: US 6,933,016 B1
(45) Date of Patent: Aug. 23, 2005

(54) METHOD OF INCREASING LATENT HEAT STORAGE OF WOOD PRODUCTS

(76) Inventor: Marvin E. Sykes, Jr., 13312 Garffe Sherron Rd., Wake Forest, NC (US) 27587

( * ) Notice: Subject to any disclaimer, the term of this patent is extended or adjusted under 35 U.S.C. 154(b) by 0 days.

(21) Appl. No.: 10/379,046

(22) Filed: Mar. 4, 2003

(51) Int. Cl.[7] ..... B05D 3/12
(52) U.S. Cl. ..... 427/297; 427/351; 427/440
(58) Field of Search ..... 427/297, 296, 427/369, 350, 351, 440, 441

(56) References Cited

U.S. PATENT DOCUMENTS 4,010,296 A * 3/1977 Oberley ..... 427/393
5,151,225 A * 9/1992 Herndon et al. ..... 252/607
5,395,656 A * 3/1995 Liang ..... 427/393
5,612,142 A * 3/1997 Lewis ..... 428/528
5,817,369 A * 10/1998 Conradie et al. ..... 427/389.9
6,235,403 B1 * 5/2001 Vinden et al. ..... 428/537.1
2002/0110644 A1 * 8/2002 Kelsoe ..... 427/397
2003/0059545 A1 * 3/2003 Kelsoe ..... 427/393

* cited by examiner

*Primary Examiner*—Timothy Meeks
*Assistant Examiner*—William Phillip Fletcher, III
(74) *Attorney, Agent, or Firm*—Mills Law Firm PLLC

(57) ABSTRACT

The heat storage capacity of natural cellulosic products is increased by injecting nucleating products and/or heat storing material into unfilled cells thereby increasing the amount of material that can undergo phase change for transferring latent heat.

6 Claims, 5 Drawing Sheets

METHOD OF INCREASING LATENT HEAT STORAGE OF WOOD PRODUCTS

FIELD OF THE INVENTION

The present invention relates to fibrous and cellulosic materials and, in particular, to natural and man-made wood products treated to improve sensible and latent heat characteristics.

BACKGROUND OF THE INVENTION

When North America was first settled, the eastern coast was forested with long-leaf, "heart pine" trees. Their wood is characterized by narrow growth rings and high cellular resinous content. In additional to structural value in construction, it was appreciated that these woods also possessed excellent heat retention properties and they were commonly employed as panel, floor and ceiling materials around the fireplace rooms, such as dens, living rooms, and dining rooms where they functioned to provide comfortable, non-insulated living spaces. Moreover, homes built entirely of such woods were regarded as more livable than homes built with other species. The preferred usage of these old growth trees continued into the late nineteenth century when the lumber supplies became depleted, and second and third growth pine became the material of choice.

While the newer woods were structurally adequate, they did not possess the apparent thermal advantage of the heart pine. They did not have either the compact ring structure or the inherent resin content, and accordingly needed to be supplemented with the available insulating materials and techniques of the time.

The advantages of the heart pine structures are many. The latent heat storing capability allowed heat retention without corresponding increases in surface temperature, thereby allowing dissipation during non-heating periods when the fireplaces, stoves, and furnaces were out. The thermal advantages also were enjoyed during summer months when the cool nights reduced the temperature structure for energy transfer as the temperature rose during the day.

Notwithstanding the above erosion of performance, structures built of solid wood are inherently energy efficient. With the continuing interest in log-type homes, reminiscent of earlier times, it would be advantageous to restore as well the unique thermal performances of the old growth trees.

Accordingly, it is an object of the present invention to provide a method for improving the energy retention and release properties of cellulosic and fibrous materials.

SUMMARY OF THE INVENTION

The foregoing objects are accomplished by treating available wood materials to increase their latent heat storage capabilities through introducing phase change agents and/or additives. In one aspect, nucleating agents are introduced that promote internal phase changes. In another aspect, supplemental resinous content is added thereby overcoming the deficiencies in new growth wood wherein the resin channels are not completely filled prior to harvest. In both, the modified material exhibits improved thermal release characteristics approaching the performance of the old growth woods.

In one aspect of the invention there is provided a method for treating wood to increase latent heat transfer capabilities by absorbing into the cellular structure of the wood an effective amount of a nucleating agent for promoting increased crystallization of the resin content in the wood. The nucleating agents are selected from the group comprising borax, boron, borosilicates, zeolites, metallic salts and sulfates. The process can be further enhanced by removing excess moisture from said wood prior to the absorbing, which may be conducted at least partially under vacuum conditions and the absorbing promoted under vacuum conditions and high pressure conditions. Supplemental resin compatible materials may also be absorbed into said wood to occupied unfilled cellular space naturally occurring and/or occasioned by removing of moisture. The materials are selected from resins, waxes, salts, salt-hydrates and cross-linked polymers. In another aspect of the invention the heat characteristics of a natural wood products having a heart area of normal resin content and a sapwood area having resin canal structure of reduced resin content are improved by infusing supplemental resin compatible materials into said resin canal structure to provide a resin content approaching said normal resin content of said heart area.

DESCRIPTION OF THE DRAWINGS

The above and other features and advantages of the invention will become apparent upon reading the following written description taken in conjunction with the accompanying drawings in which.

DETAILED DESCRIPTION OF THE PREFERRED EMBODIMENTS

Figure 2B:
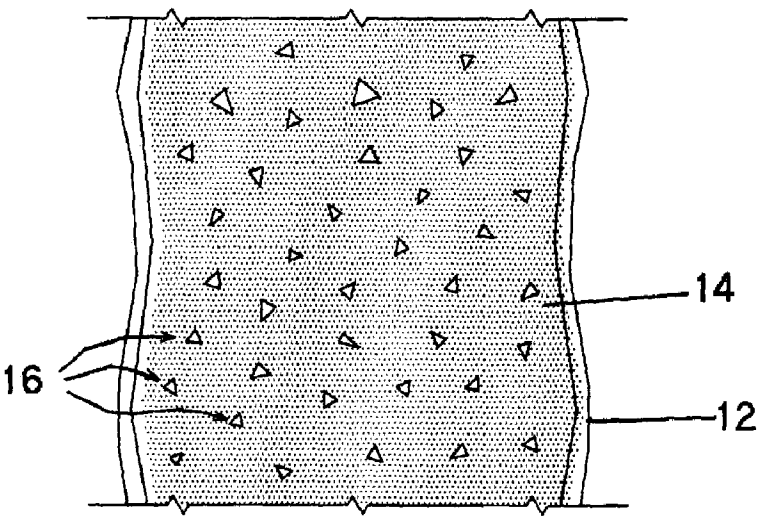
FIGS. 2A and 2B are schematic views of resin canals in coniferous wood with and without the processing of the present invention.
Figure 2A:
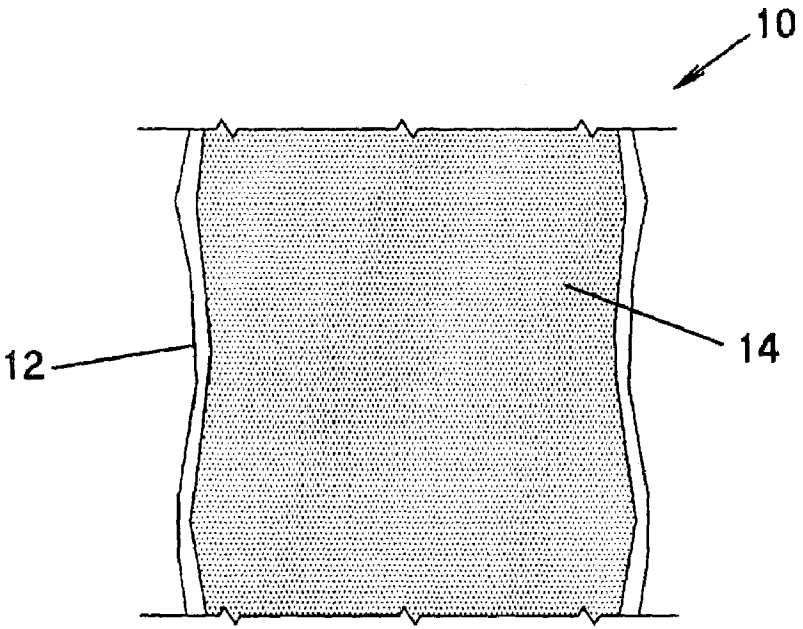
Figure 3B:
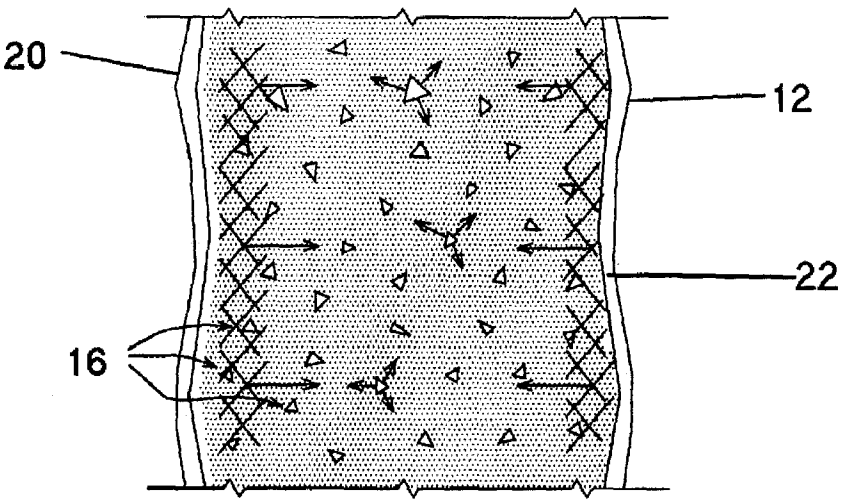
FIGS. 3A and 3B are schematic views of resin canals showing normal crystallization in unprocessed wood and crystallization of wood processed in accordance with the invention.
Figure 3A:
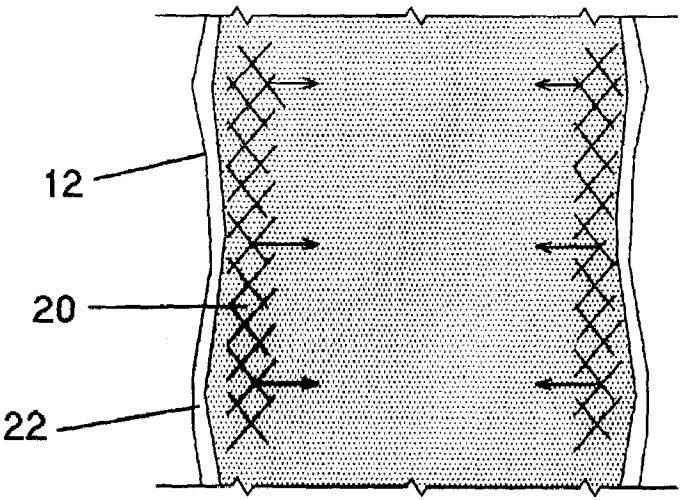

The present invention provides thermally enhanced wood products treated or altered to improve heat storage capacity and/or change the heat retention and release properties. Referring to FIG. 2A, natural unprocessed wood 10 is characterized by resin canals 12 that are in whole or in part filed with resin 14. As described below and as shown in FIG. 2B, nucleating agents 16 are inserted into the resin canals 12 and cause a phase change in response to temperature fluctuations resulting in improved latent heat properties and increase the release or absorption of thermal energy. Such core structure is typical of resinous wood. As shown in FIG. 3A, the resin canals 12 normally undergo progressive crystallization in a peripheral zone 20 inwardly of the canal wall 22. As shown in FIG. 3B, the nucleating agents 16 are effective to propagate the crystallization both inwardly and outwardly to greatly increase the phase change material (PCM) volume thereby increasing the latent thermal potential of the material.

Figure 4B:
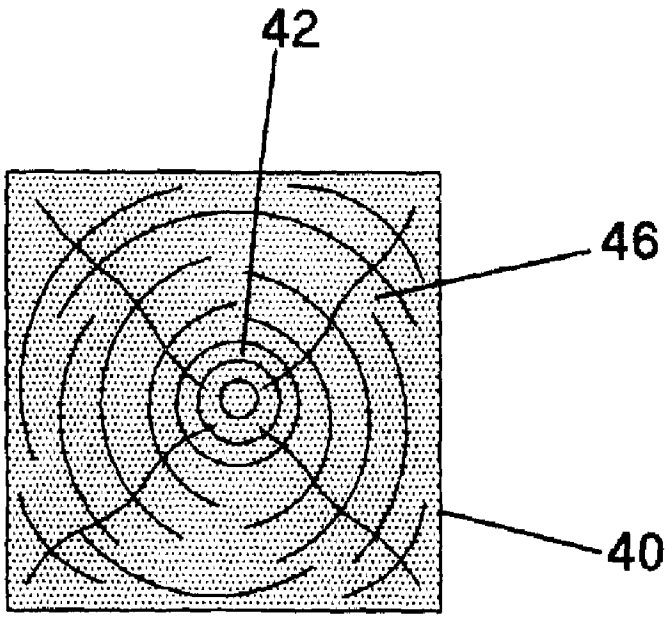
FIGS. 4A and 4B are schematic views showing the effect of adding resin to sapwood cells of young growth timber.
Figure 4A:
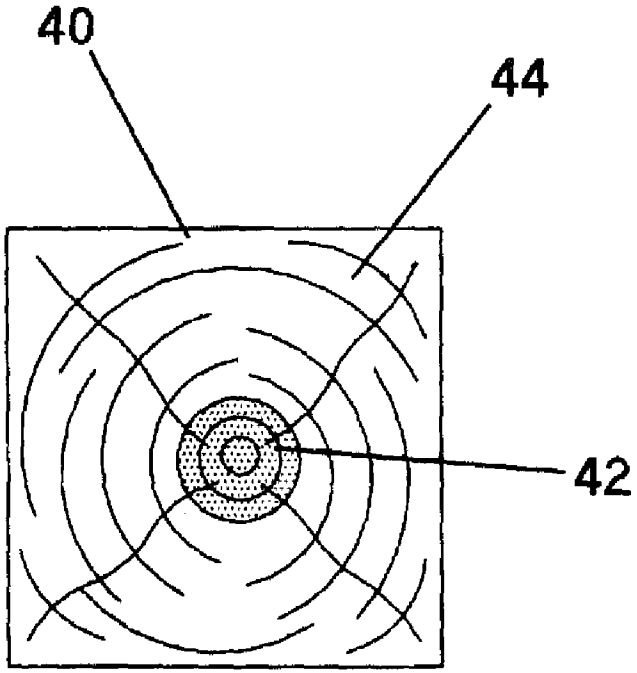

The latent thermal potential of resinous wood can also be enhanced by increasing the resin content, thereby reintroducing many of the thermal advantages afforded by the heart pine type woods. Referring to FIG. 4A, a typical second or subsequent growth pine or like wood 40 is characterized by small heart area 42, rich in resin content, surrounded by a sapwood area 44 having a lesser or deficient resin content. Referring to FIG. 4B, the present invention provides a process for introducing a resinous content throughout the sapwood area to provide an enhanced thermal zone 46 having thermal characteristic of the heart area.

Both of the foregoing are applicable to a wide variety of woods and fibrous materials including new growth pines, plantation-grown pines, hardwoods, straw, and bamboo.

Figure 1:
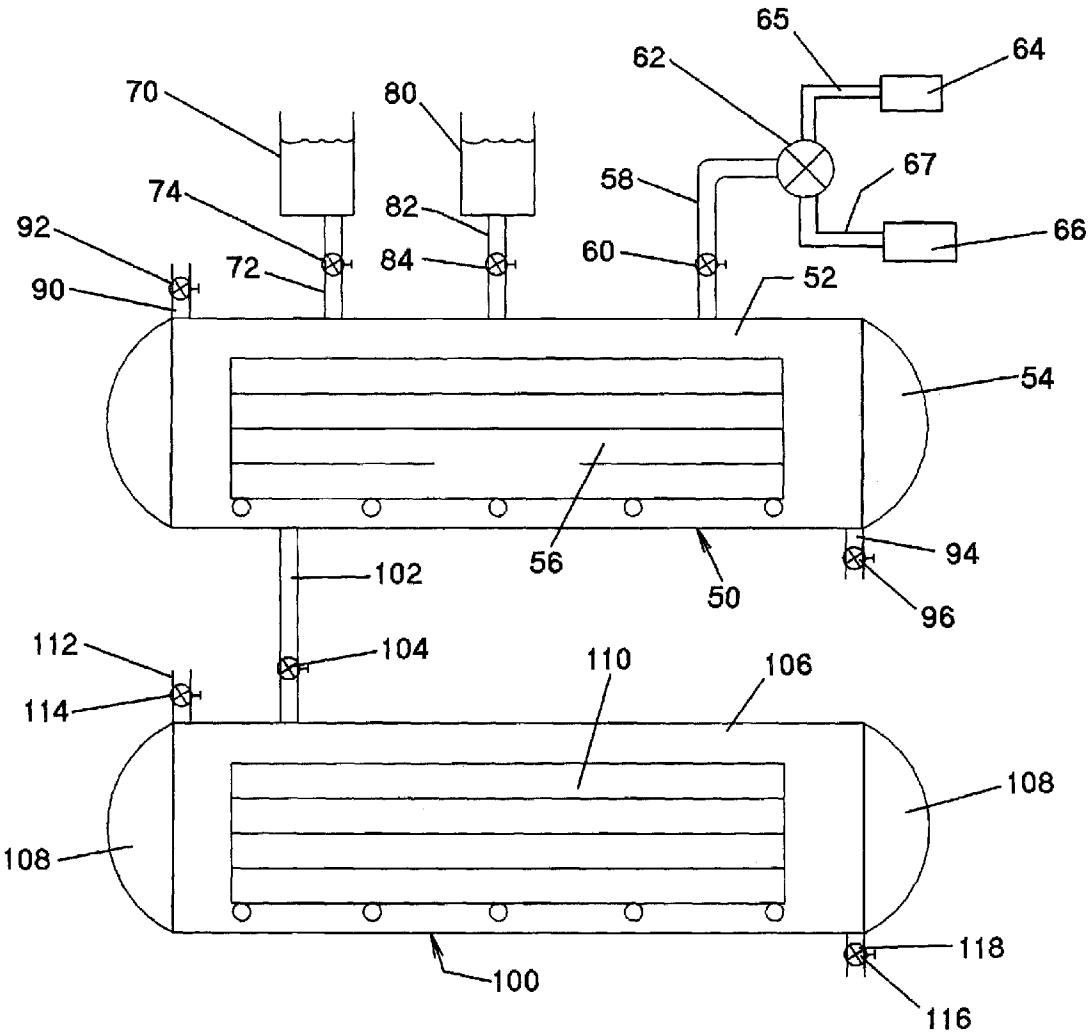
FIG. 1 is a schematic view of a process for treating wood product according to the invention.

Referring to FIG. 1, there is illustrated a process for improving the thermal capacitance or wood products. Therein a main pressure vessel 50 having an interior cavity 52 that is accessible by end doors 54 for introducing and removing wood products 56 as rough cut lumber. The vessel 50 is connected by line 58 including a control valve 60 to a three-way selector valve 62 for allowing selective connection with a vacuum source 64 by line 65 or a pressure source 66 by line 67.

A liquid resin source 70 is connected to the vessel 50 by supply line 72 including control valve 74. A nucleating agent source 80 is connected to the vessel 50 by supply line 82 including control valve 84. Vent line 90 including vent valve 92 communicates with the cavity 52 for atmospheric venting thereof. A drain line 94 including drain valve 96 communicates with the cavity for removing liquid and/or solid contents therefrom.

For purposes hereinafter described, a secondary vessel 100 may be fluidly connected with the vessel 50 by auxiliary line 102 including control valve 104. The secondary vessel 100 includes a cavity 106 accessible by end doors 108 for loading and removing a wood load 110 therefrom. The cavity 106 is vented to atmosphere by vent line 112 including vent valve 114. A drain line 116 including drain valve 118 communicates with the cavity 106 for removing liquid and/or solid contents therefrom.

The vessels 50 and 106 are capable of handling high pressure conditions of about 100 psi and above and withstanding low vacuum conditions of about 28 in Hg or below. As required by the environment or processed materials, the vessels may be jacketed or insulated for achieving and maintaining desired processing conditions. The sources 70 and 80 as well as associated lines and components may also be appropriately temperature controlled. Injectable materials in the resin source 70, in particular, are preferred in the liquid state, thus requiring elevated temperature control. The nucleating agents in the source 80 are preferably in solution, also requiring temperature control.

Suitable resins for the process include natural and synthetic resins, waxes, salts, salt-hydrates or cross linked polymers, or solutions thereof. Suitable nucleating agents include zeolites, borax, borate, boron, borosilicates, metallic salts or sulfate.

The process is initiated using timbers and lumber and removing the free-cell water through air drying, kiln drying, vacuum drying, dehumidification, desiccant drying, microwave heating, steam conditioning or the like. The drying may take place entirely or partially exterior of the pressure vessel 50. Alternatively, the drying may be performed, totally or partially, in the pressure vessel 50. Thereat, the material charge of wood product 56 is loaded into the cavity 52 through door 54 and the valves 62, 60 opened to connect to the vacuum source 64. The cavity 52 is evacuated to a high vacuum of about 28 in Hg or greater for a sufficient time to remove the free-cell water to appropriate levels based on the desired subsequent processing. Generally about 40 minutes or less is preferable depending on the density and saturation of the material charge. Thereafter, the valves 62, 60 are closed, the vacuum source 64 disabled and the valve 74 is opened to inject the liquids from source 70 and during the course thereof raising the pressure to atmospheric, at which time or based on requirements therebefore the valve 74 is closed. Next the pressure source 66 is enabled, the valve 62 conditioned to pressurize the cavity to a pressure of about 150 psi for an extended period, up to about 3 hours, sufficient to get the maximum resin content absorbed into the product. The amount of liquid resin introduced in this step will be dependent on the starting resin content of the load, which may vary considerably based on source.

Concurrently with injection, the valve 84 is opened to inject the nucleating agents are introduced from the source 80 through line 82 into the cavity 52. In the event the agents are not in a solution form compatible with the injectables, the nucleating agents may be introduced in a secondary evacuation followed by pressurization, which may be entirely sequential after the injection sequence or a sequential evacuation and a common pressurization. Without resin treatment, about 0.2 to 1.0 pounds of nucleating agents per cubic foot of load may be required. If the load has been resin treated, additional nucleating agents in the range of about 0.5 to 2.0 pound per cubic foot of load should be sufficient. Depending on the selected nucleating agent, the step may be conducted exterior of the vessel through infusion by immersion or osmosis.

Following treatment, the lumber may be dried for usage, artificially or ambiently. In the event of weeping of the resin content from the material, the excess may be hardened through subsequent conventional processing to polymerize, cross link or harden the same.

In a variation of the above process, a secondary material load may be placed in vessel 100 and co-evacuated with primary vessel 50 through line 102. For a secondary material load high in resin content, the released resin vapor will be drawing into cavity 52 thus supplanting or reducing the amount of resin necessary treat the load 56. The resulting product in vessel 100, free of water and resins, is a light empty cell product much like balsa wood, useful for insulation.

It will be appreciated that foregoing provides thermally enhanced characteristic for a varied wood sources. Young rapid growth trees having a marked resin deficiency will have the characteristics of the old growth wood as shown in FIG. 4B. Adding the nucleating agents will provide a phase change matrix increasing the thermal capacitance improving the latent heat capabilities of structures based on or incorporating the treated wood. By maximizing the use of such materials in construction in substitution for conventional source, the energy efficiency of the buildings can be greatly increased.

Figure 5A:
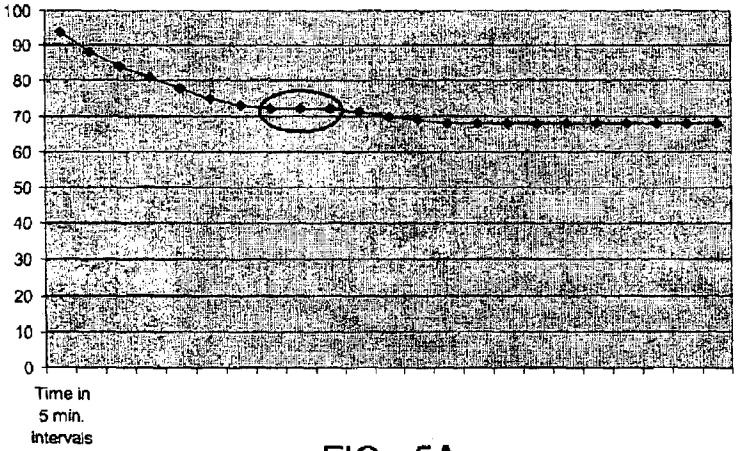
FIGS. 5A and 5B are graphs showing the effect of surface temperature versus time for wood products samples with and without treatment with the nucleating agents of the invention.
Figure 6A:
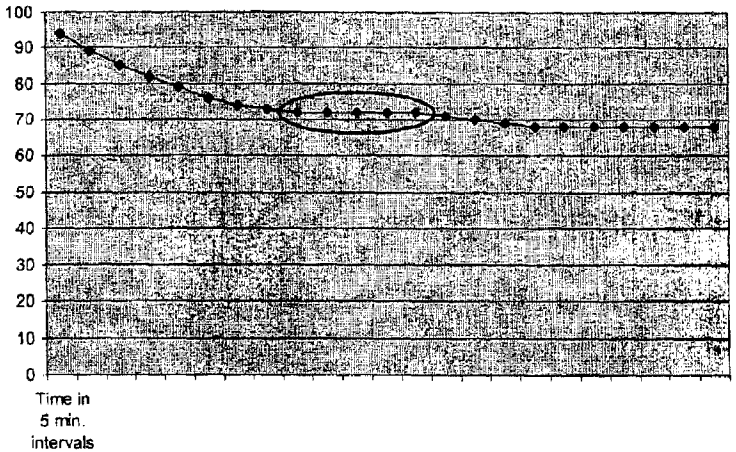
FIGS. 6A and 6B are graphs showing the effect of surface temperature versus time for other wood products with and without treatment with the nucleating agents of the invention.
Figure 5B:
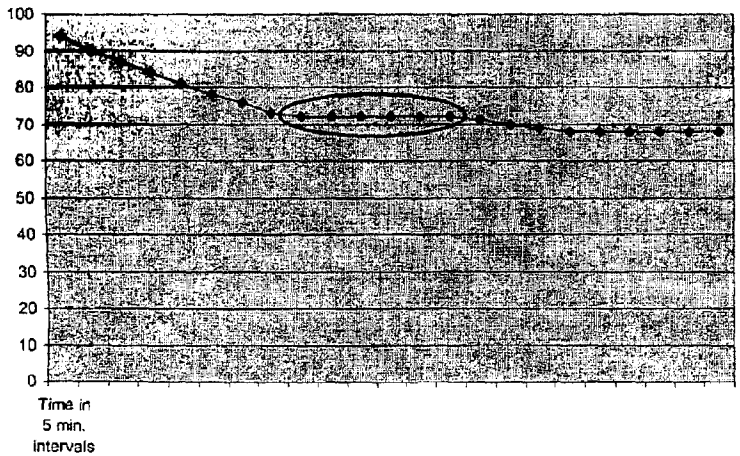
Figure 6B:
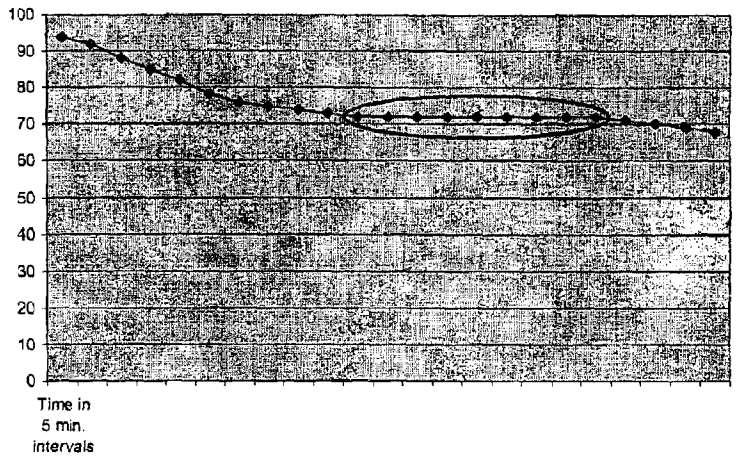

The foregoing advantages are shown by examples depicted in the graphs of FIGS. 5 and 6. Wood product samples measuring 5.75 in. by 5.75 in. by 12 in. and having a heart diameter of 1.69 were for the example of FIG. 5. The sample of FIG. 5A was unprocessed and the sample of FIG. 5B was infused with 0.15 lbs. of borax. It will be noted that the unprocessed sample had a latent heat period, i.e. the constant surface temperature period of 72° F. for 10 minutes whereas the treated sample had a latent heat period of 20 minutes, or a 100% increase. The samples of FIG. 6 had a heart diameter of 5.75 in. and similar nucleating treatment.

The unprocessed sample had a latent heat period of 20 minutes whereas the treated sample had a corresponding period of 40, once again about double the untreated condition. Both clearly establish the improved latent heat capabilities achieved in one aspect of the invention.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A method for treating wood comprising: absorbing into the cellular structure of said wood a solution containing about 0.2 to 1.0 pounds per cubic foot of wood of a nucleating agent selected from the group consisting of borax and zeolites, whereby the nucleating agent increases the crystallization of the resin content of the wood and increases the latent heat transfer capabilities of the wood.

2. The method as recited in claim 1 including the step of removing excess moisture from said wood prior to the step of absorbing.

3. The method as recited in claim 2 wherein said removing excess moisture is conducted at least partially under vacuum conditions and said absorbing is promoted under vacuum conditions and high pressure conditions.

4. The method as recited in claim 2 wherein supplemental natural resin compatible materials are absorbed into said wood prior to said absorbing to occupy unfilled cellular space naturally occurring and/or occasioned by said removing of moisture.

5. The method as recited in claim 4 wherein said supplemental natural resin compatible materials are absorbed under vacuum conditions and high pressure conditions.

6. The method as recited in claim 4 wherein said supplemental natural resin compatible materials are selected from the group consisting of resins, waxes, salts, salt-hydrates and cross-linked polymers, and wherein said effective amount is increased by about 0.5 to 2.0 pounds per cubic foot.

* * * * *